US010060604B2

(12) United States Patent
Shackelford

(10) Patent No.: US 10,060,604 B2
(45) Date of Patent: Aug. 28, 2018

(54) LED PARKING LOT LIGHT RETROFIT

(71) Applicant: Darrel R. Shackelford, Gladstone, MO (US)

(72) Inventor: Darrel R. Shackelford, Gladstone, MO (US)

(73) Assignee: LED INSERT KIT ENTERPRISES, LLC, Kansas City, MO (US)

( * ) Notice: Subject to any disclaimer, the term of this patent is extended or adjusted under 35 U.S.C. 154(b) by 0 days.

(21) Appl. No.: 15/344,840

(22) Filed: Nov. 7, 2016

(65) Prior Publication Data

US 2017/0130908 A1 May 11, 2017

Related U.S. Application Data

(60) Provisional application No. 62/252,878, filed on Nov. 9, 2015.

(51) Int. Cl.

| | |
|---|---|
| ***F21S 8/00*** | (2006.01) |
| ***F21V 17/12*** | (2006.01) |
| ***F21V 23/00*** | (2015.01) |
| ***F21V 31/00*** | (2006.01) |
| ***F21S 8/08*** | (2006.01) |
| *F21W 131/103* | (2006.01) |
| *F21Y 113/00* | (2016.01) |
| *F21Y 115/10* | (2016.01) |

(52) U.S. Cl.

CPC ..... *F21V 17/12* (2013.01); *F21S 8/086* (2013.01); *F21V 23/001* (2013.01); *F21V 31/005* (2013.01); *F21W 2131/103* (2013.01); *F21Y 2113/00* (2013.01); *F21Y 2115/10* (2016.08)

(58) Field of Classification Search

CPC ..... F21S 8/086; F21W 2131/103

See application file for complete search history.

(56) References Cited

U.S. PATENT DOCUMENTS

| | | | | |
|---|---|---|---|---|
| 7,488,086 | B2 | 2/2009 | Wu et al. | |
| 7,784,970 | B2 | 8/2010 | Sun | |
| 7,922,372 | B2 | 4/2011 | Li | |
| 8,177,398 | B2 | 5/2012 | Yao | |
| 8,197,115 | B2 | 6/2012 | Wilkinson et al. | |
| 8,256,919 | B2 | 9/2012 | Holder et al. | |
| 8,506,126 | B2 | 8/2013 | Quirion et al. | |
| 8,628,217 | B2 | 1/2014 | Moshtagh | |
| 8,777,453 | B2 | 7/2014 | Donegan | |
| 8,896,207 | B2 | 11/2014 | Thomas et al. | |
| 9,033,558 | B2 | 5/2015 | Farmer | |
| 2006/0056169 | A1* | 3/2006 | Lodhie | F21S 8/086 362/97.3 |
| 2009/0021940 | A1 | 1/2009 | Troller et al. | |
| 2010/0165616 | A1* | 7/2010 | Wilkinson | F21S 2/005 362/231 |
| 2012/0049751 | A1 | 3/2012 | Wang | |
| 2012/0262920 | A1 | 10/2012 | Longardner | |

(Continued)

*Primary Examiner* — Sean Gramling

(74) *Attorney, Agent, or Firm* — Grace J. Fishel

(57) ABSTRACT

A replacement LED insert module for retrofitting a pre-existing shoe box parking lot light. The module includes a plate into which an array of LED light fixtures capable of being operated directly from an AC power supply are mounted. The module is configured for attachment to a flange in the pre-existing shoe box parking lot light after the innards of the pre-existing light (bulbs, any reflectors, ballasts, etc.) have been removed.

10 Claims, 5 Drawing Sheets

(56) References Cited

U.S. PATENT DOCUMENTS

| | | | |
|---|---|---|---|
| 2013/0016510 | A1 | 1/2013 | Sanders et al. |
| 2014/0092609 | A1 | 4/2014 | Moshtagh |
| 2015/0009649 | A1 | 1/2015 | Jagt et al. |
| 2015/0029732 | A1 | 1/2015 | Hatch |

* cited by examiner

LED PARKING LOT LIGHT RETROFIT

BACKGROUND OF THE INVENTION

Field of the Invention

The present invention relates to an LED insert module to replace halogen and fluorescent lamps typically found in shoe box parking lot lights.

Brief Description of the Prior Art

Conventional halogen and fluorescent bulbs in parking lot lights suffer from a number of limitations, including high power consumption, short life expectancy, contribution to heavy metal pollution and/or poor light output quality in terms of color rendering. LEDs by design are more durable and have longer life expectancy. LEDs also have superior light quality as compared to fluorescent lights, for example, in that they may generate a white light that looks much brighter, making people feel more secure. Heretofore, the replacement of halogen and fluorescent lights has been hindered by operating difference between halogen and fluorescent lights and LEDs which require a low voltage DC power source.

The present invention fills the above unmet need to update shoe box parking lot lights by making use of LED lighting fixtures which may be operated directly from an AC power supply.

BRIEF SUMMARY OF THE INVENTION

In view of the above, it is an object of the present invention to provide an economic LED retrofit for shoe box parking lot lights that makes use of commercially available LED lighting fixtures which may be operated directly from an AC power supply. More particularly, it is an object to provide a LED retrofit module for use in shoe box parking lot lights that provides higher luminous efficiency, longer life and no heavy metal pollution. Other objects and features of the invention will be in part apparent and in part pointed out hereinafter.

In accordance with the invention, a replacement LED insert module is provided for installation in a pre-existing shoe box parking lot light from which a lens and a halogen or fluorescent light source and associated ballast have been removed leaving behind electrical wires connected to AC mains and an outer wall and an inwardly directed flange to which the lens was hinged.

The LED insert module includes a plate which is configured for attachment to the flange. A plurality of apertures are provided in the plate into each of which is clipped a recessed LED lighting fixture of the kind that may be operated directly from an AC power supply. The LED lighting fixture has a housing assembly with an opening in a bottom face thereof that communicates with a recess in the housing assembly. One or more LED light sources are positioned within the recess of housing assembly such that the LEDs emit light though the opening of the housing assembly. Lead wires connect the LED light source to the AC mains. A moisture gasket is provided on the housing assembly for flush mounting of the LED lighting fixture on a front face of the plate and clips are provided for securing the housing assembly to the plate on a rear face of the plate. In a preferred embodiment of the LED insert module, the plate is formed of aluminum.

The invention summarized above comprises the constructions hereinafter described, the scope of the invention being indicated by the subjoined claims.

BRIEF DESCRIPTION OF THE SEVERAL VIEWS OF THE DRAWINGS

In the accompanying drawings, in which several of various possible embodiments of the invention are illustrated, corresponding reference characters refer to corresponding parts throughout the several views of the drawings in which.

DETAILED DESCRIPTION OF AT LEAST ONE PREFERRED EMBODIMENT OF THE INVENTION

Figure 1:
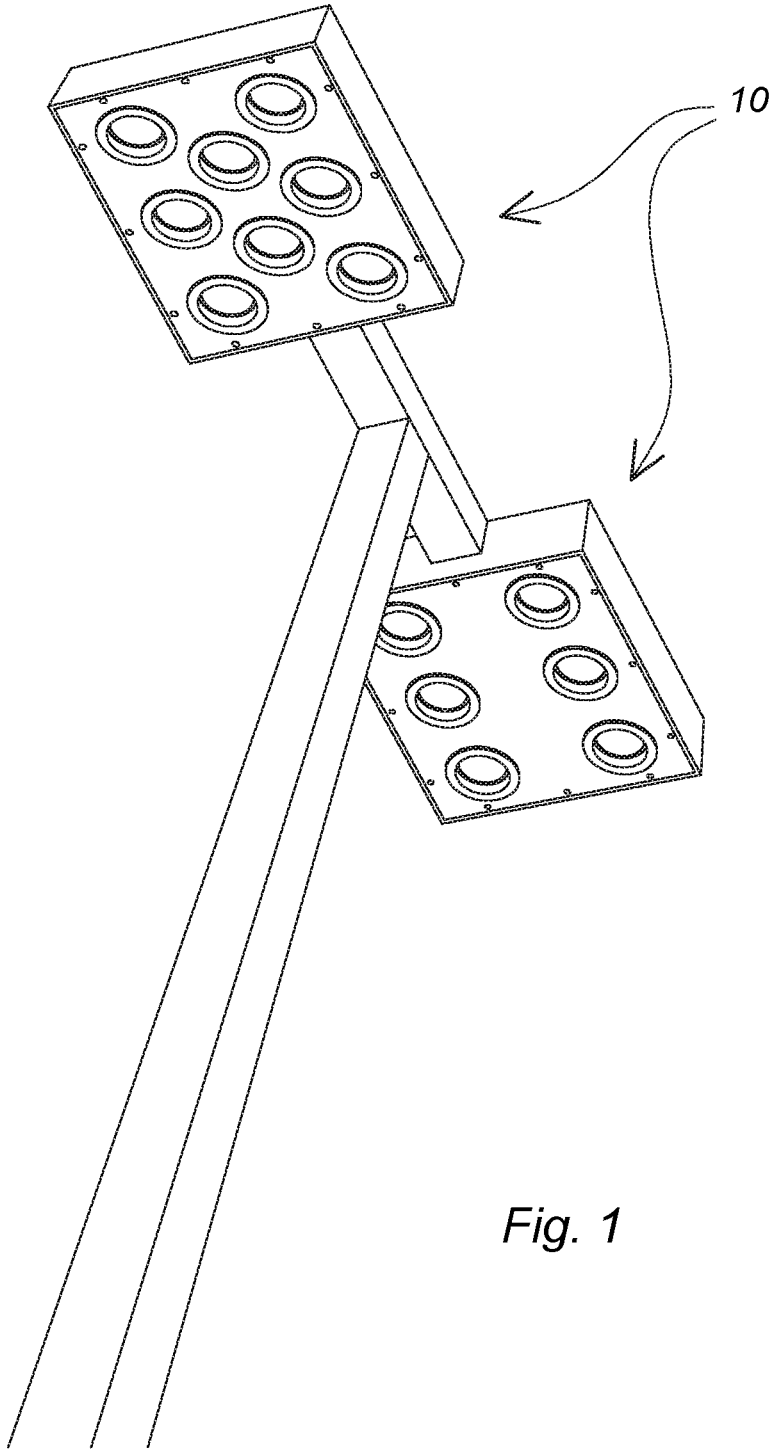
FIG. 1 is a view looking up into a retrofitted shoe box parking lot light.

Referring to the drawings more particularly by reference character, reference numeral 10 refers to a replacement LED insert module in accordance with the present disclosure. Module 10 is configured for installation in a pre-existing shoe box parking lot light 12 as shown in FIG. 1. Module 10, as compared to halogen and fluorescent parking lot lights, eliminates maintenance costs for 5 years or 10,000 hours or more and also considerably lowers the electric bill.

Figure 2:
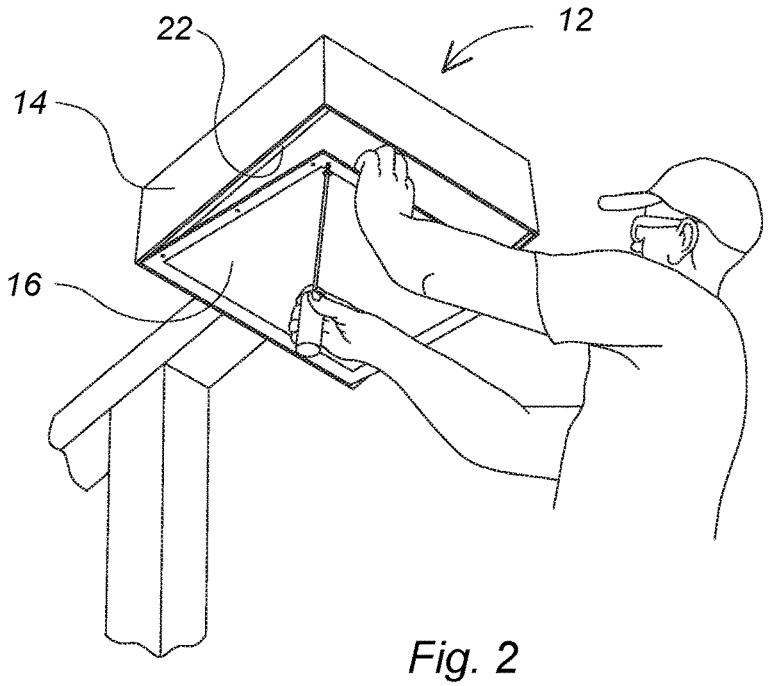
FIG. 2 is a perspective view of a workman unscrewing a lens cover on an existing shoe box parking lot light.
Figure 3:
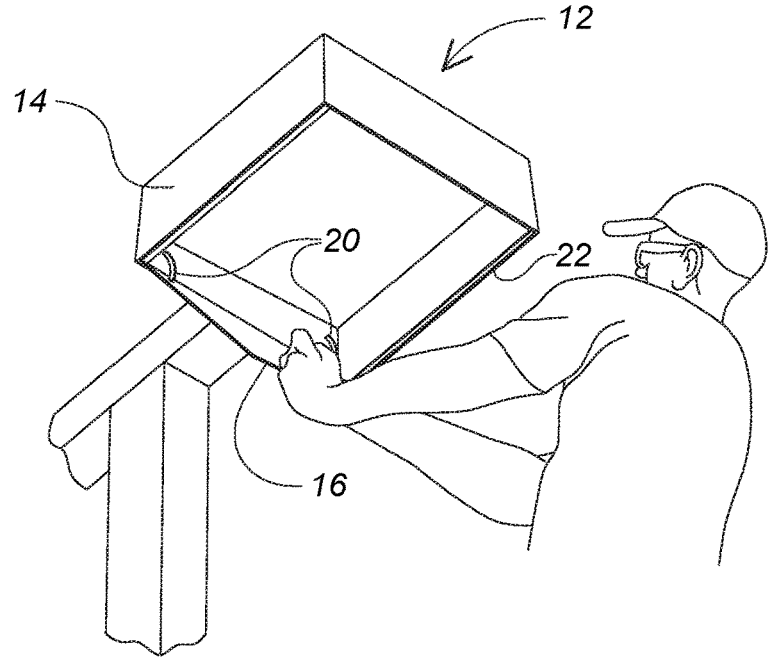
FIG. 3 is a perspective view of the lens cover hinged open in process of being removed by the worker.
Figure 4:
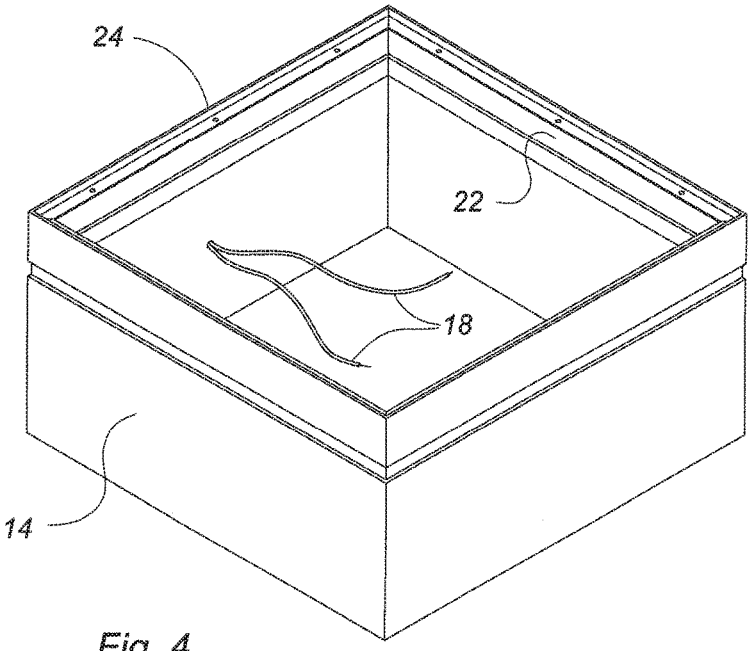
FIG. 4 is a view looking inside the housing of an existing shoe box parking lot light after the lens cover, halogen or fluorescent light source and associated ballast are removed leaving behind the electrical wires connected to AC mains and an inwardly directed flange above the bottom edge of the housing.

Shoe box parking lot light 12 includes a housing 14 from which a lens cover* 16, a halogen or fluorescent light source and associated ballast are removed leaving behind electrical wires* 18 connected to AC mains as shown in FIG. 4. As shown in FIGS. 2 and 3, lens cover 16 prior to its removal is hinged 20 to the inside of shoe box housing 14 and attached with screw fasteners to an inwardly directed flange 22 which is positioned above a bottom edge 24 of housing 14.

Figure 5:
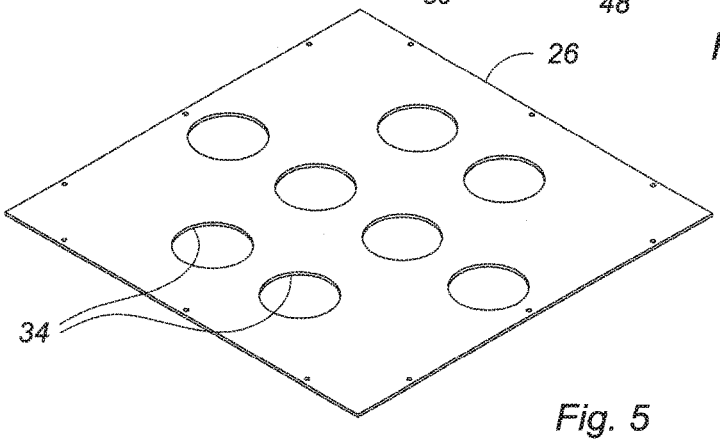
FIG. 5 is a perspective view of a plate with an array of holes for installation of a plurality of LED light fixtures.

Module 10 includes a plate 26 as shown in FIG. 5. Plate 26 is sized such that fits inside housing 14 and may be attached with self-tapping screws 28 or the like to flange 22. Because of differences among shoe box parking lot lights 12 made by different manufacturers, it is necessary to measure the opening of housing 14 to properly size plate 26 for proper fit on flange 22. While plate 26 is illustrated as rectangular in shape it may take other forms depending on the shape of housing 14 to which it is attached on flange 22. Plate 26 is preferably formed of aluminum which is lightweight, does not rust and is a good heat dissipator. Aluminum plate 26 as shown in FIG. 5 is 3/32 inch thick and is strong enough to support an array of LED lighting fixtures 32. In the embodiment shown in FIG. 5, a plurality of apertures 34 are symmetrically arranged on plate 26 in three ranks for attachment of 8 LED lighting fixtures 32. It will be understood that other arrangements and numbers of apertures 34 and LED lighting fixtures 32 may be used to provide the illumination or appearance of module 10 desired.

Figure 6:
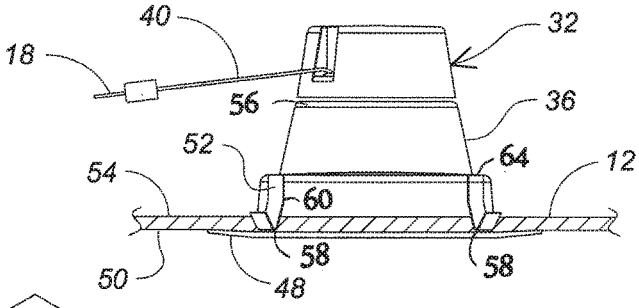
FIG. 6 is a side elevation of a LED light lamp fixture.

As shown in FIG. 6, LED lighting fixture 32 includes a housing assembly 36 with an opening in the bottom face thereof. Opening communicates with a recess in the housing assembly in which an LED light source is positioned such that it emits light through the opening. In certain embodiments, the LED light source includes at least one LED. In other embodiments, the at least one LED includes a plurality of LEDs.

Figure 8:
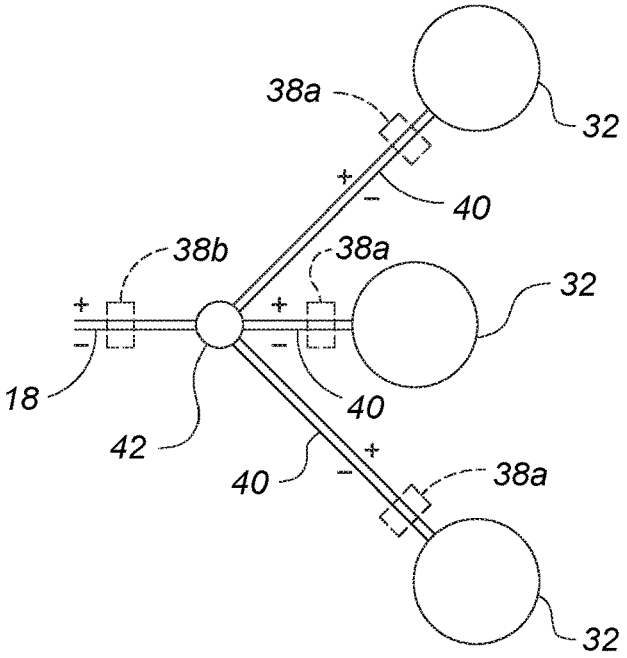
FIG. 8 is a wiring diagram for three LED light fixtures with their lead wires joined to the AC mains with a wire nut.
Figure 9:
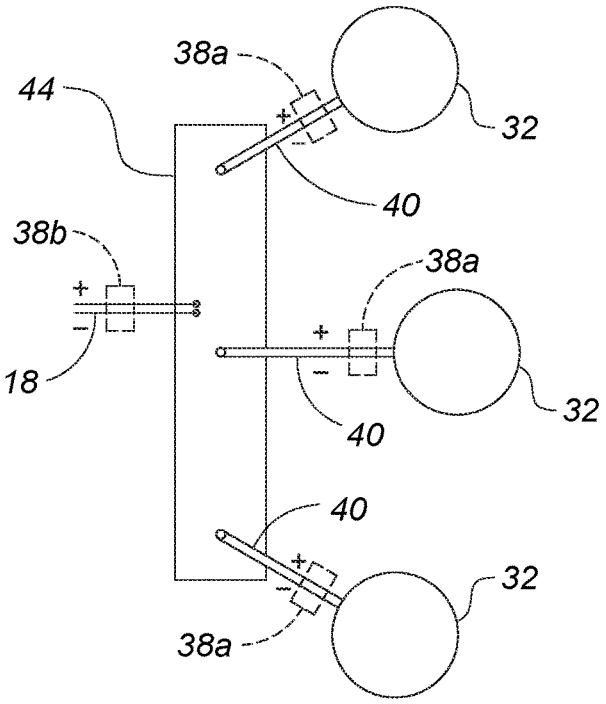
FIG. 9 is a wiring diagram for three LED light fixtures with their lead wires joined to the AC main through a wiring strip; and, FIG. 10 is an exploded view of a retrofitted shoe box parking lot light with a replacement LED insert module.

Electronics 38 to provide DC voltage capable of driving the LED lighting fixtures 32 are provided between AC power supply 18 and the LED light source in LED lighting fixtures 32. As shown in the wiring diagrams in FIGS. 8 and 9, separate electronics 38*a* may be provided as part of each LED lighting fixture 32 or electronics 38*b* may be provided in circuit with the LED lighting fixtures 32 and mounted on plate 26. As illustrated in FIG. 8, the LED lighting fixtures 32 are wired in parallel with lead wires 40 connected to the AC mains 18 bundled together with a wire nut 42. In other cases, lead wires 40 are connected to the AC mains 18 through a distribution strip 44. Lead wires 44 connect the LED light source to AC mains 18. Lead wires 40 from the LED lighting fixtures 32 may be connected with a plug-style termination 46 as shown in FIG. 6, however, other terminations are contemplated (e.g., bare wires, etc.).

Figure 7:
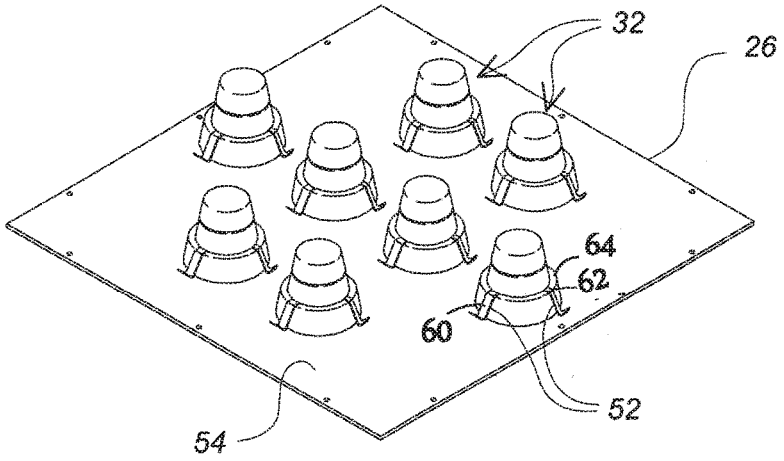
FIG. 7 is a perspective view of an LED insert module for retrofitting the shoe box parking lot light with the LED light fixtures installed in the plate.
Figure 10:
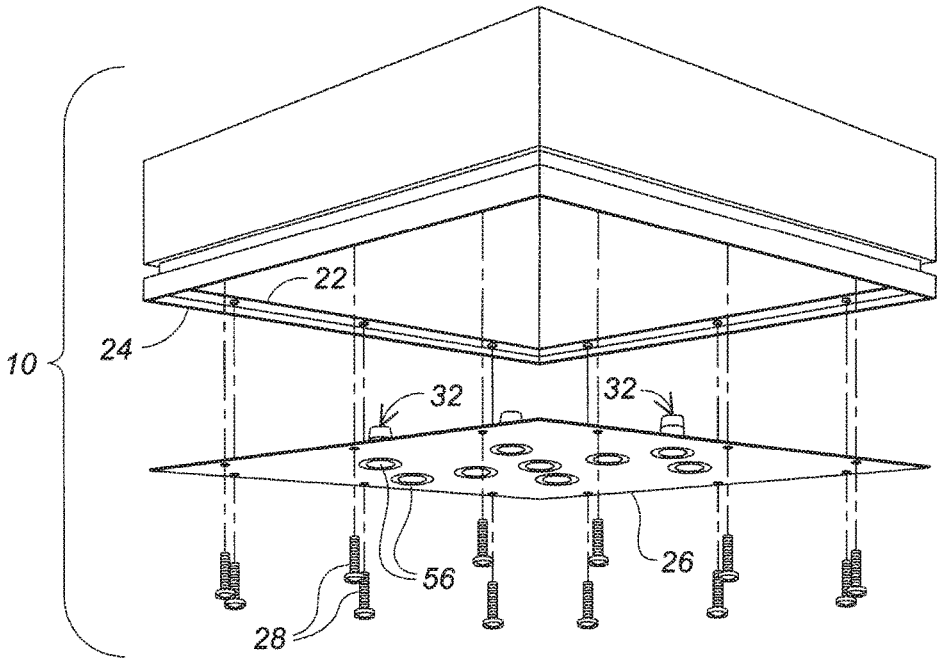

Housing assembly 36 includes an integral moisture gasket 48 for flush mounting of LED lighting fixture 32 on a front face 50 of plate 26 as seen in FIG. 6. Clips 52 are provided for securing housing assembly 36 to a rear face 54 of plate 26 as shown in FIG. 6. Each of clips 52 has a V-shaped end 58, a middle portion 60 (FIG. 6) and a flange 62 (FIG. 7) attached to a shoulder 64 in the housing assembly above the moisture gasket 48. A reflector 56 may be installed through opening in the recess of housing assembly 36. Reflector 56 is operable to direct light generated by LED light source out of opening.

In use, after LED lighting fixtures 32 are installed on plate 26 and lead wires 40 attached to AC mains 18 through electronics 38 (a or b), self tapping screws 28 may be used to attach plate 26 to flange 22 thus completing an installation of module 10 in shoe box parking lot light 12 whereupon the benefits of the conversion mentioned above are enjoyed.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A preexisting shoe box parking lot light from which a lens cover and a halogen or fluorescent light source and associated ballast have been removed leaving behind electrical wires connected to AC mains, said housing having a outer wall and an inwardly directed flange to which the lens cover was hinged, said flange spaced above a bottom edge of the outer wall, a replacement LED module comprising a plate attached to the flange, said plate having a plurality of apertures into each of which is clipped a recessed LED lighting fixture configured to be operated directly from an AC power supply, said recessed LED lighting fixture including a housing assembly with an opening in a bottom face thereof, said opening communicating with a recess in the housing assembly, a LED light source positioned within the recess of housing assembly such that it emits light though the opening of the housing assembly, lead wires for connecting the LED light source to the AC mains, a moisture gasket provided on the housing assembly for flush mounting of the LED lighting fixture on a front face of the plate, clips provided for securing the housing assembly to the plate on a rear face of the plate, each of said clips having a V-shaped end, a middle portion and a flange, said flange attached to a shoulder in the housing assembly above the moisture gasket.

2. The replacement LED insert module of claim 1 wherein electronics to provide a DC voltage capable of driving the LED lighting fixtures are provided between the LED lighting fixtures and the AC mains.

3. The replacement LED insert module of claim 2 wherein electronics to provide a DC voltage capable of driving the LED lighting fixtures are provided between each LED lighting fixture and the AC mains.

4. The replacement LED insert module of claim 2 wherein lead wires from the LED lighting fixtures are wired joined together for connection to the AC mains and electronics are provided between the joined together lead lines and the AC mains.

5. The replacement LED insert module of claim 2 wherein the electronics are provided in each LED lighting fixture.

6. The replacement LED insert module of claim 1 wherein the plate is formed of aluminum.

7. A preexisting shoe box parking lot light from which a lens cover and a halogen or fluorescent light source and associated ballast have been removed leaving behind electrical wires connected to AC mains, said housing having a outer wall and an inwardly directed flange to which the lens cover was hinged, said flange spaced above a bottom edge of the outer wall, an LED insert module having a plate attached to the flange, said plate having a plurality of apertures into each of which is clipped a recessed LED lighting fixture configured to be operated directly from the AC power supply, said recessed LED lighting fixture including a housing assembly with an opening in a bottom face thereof, said opening communicating with a recess in the housing assembly, a LED light source positioned within the recess of housing assembly such that it emits light though the opening of the housing assembly, lead wires connecting the LED light source to the AC mains, a moisture gasket provided on the housing assembly for flush mounting of the LED lighting fixture on a front face of the plate, clips provided for securing the housing assembly to the plate on a rear face of the plate, each of said clips having a V-shaped end, a middle portion and a flange, said flange attached to a shoulder in the housing assembly above the moisture gasket.

8. The retrofitted shoe box parking lot light of claim 7 wherein the lead lines from the LED lighting fixtures are connected to the AC mains through a distribution strip.

9. The retrofitted shoe box parking lot light of claim 8 wherein there are three LED lighting fixtures in each LED insert module.

10. The retrofitted shoe box parking lot light of claim 8 wherein the plate is formed of aluminum.

* * * * *